US011233304B2

(12) United States Patent
Hollenbeck et al.

(10) Patent No.: US 11,233,304 B2
(45) Date of Patent: Jan. 25, 2022

(54) IRREGULAR HEXAGON CROSS-SECTIONED HOLLOW METAL WAVEGUIDE FILTERS

(71) Applicant: Optisys, LLC, West Jordan, UT (US)

(72) Inventors: Michael Hollenbeck, West Jordan, UT (US); Robert Smith, West Jordan, UT (US)

(73) Assignee: Optisys, LLC, West Jordan, UT (US)

( * ) Notice: Subject to any disclaimer, the term of this patent is extended or adjusted under 35 U.S.C. 154(b) by 112 days.

(21) Appl. No.: 16/688,988

(22) Filed: Nov. 19, 2019

(65) Prior Publication Data

US 2020/0194855 A1 Jun. 18, 2020

Related U.S. Application Data

(60) Provisional application No. 62/769,505, filed on Nov. 19, 2018.

(51) Int. Cl.
*H01P 1/207* (2006.01)
*H01P 3/123* (2006.01)

(52) U.S. Cl.
CPC ..... *H01P 1/207* (2013.01); *H01P 3/123* (2013.01)

(58) Field of Classification Search
CPC ..... H01P 1/207; H01P 3/123
See application file for complete search history.

(56) References Cited

U.S. PATENT DOCUMENTS 3,777,286 A 12/1973 Cramm et al.
4,297,658 A 10/1981 Treczka
4,467,294 A 8/1984 Janky et al.
6,018,315 A 1/2000 Ince et al.
6,137,450 A 10/2000 Bhattacharyya et al.
6,198,730 B1 3/2001 Hogberg et al.
6,501,434 B1 12/2002 Hollenstein et al.
7,480,435 B2 1/2009 Brist et al.
9,253,925 B1 2/2016 Smith
10,170,833 B1 1/2019 Hollenbeck et al.
10,468,773 B2 11/2019 Hollenbeck et al.
10,481,253 B1 11/2019 Hollenbeck et al.
(Continued)

FOREIGN PATENT DOCUMENTS

FR 3087954 A1 10/2018
GB 2275454 B 8/1994
(Continued)

OTHER PUBLICATIONS

Machine translation prepared on Jan. 27, 2020, by the European Patent Office for Publication No. WO 2017208153.

*Primary Examiner* — Robert J Pascal
*Assistant Examiner* — Kimberly E Glenn
(74) *Attorney, Agent, or Firm* — Terrence J. Edwards; TechLaw Ventures, PLLC

(57) ABSTRACT

A waveguide filter includes a fundamental waveguide unit. The fundamental waveguide unit may have an irregular hexagonal metal structure. One wall of the irregular hexagonal metal structure may form a connection to one or more walls of another fundamental waveguide unit having an irregular hexagonal metal structure. A fundamental waveguide unit may include a hollow irregular hexagonal metal structure which includes a resonant cavity that receives an electromagnetic signal and propagates the signal through the resonant cavity.

23 Claims, 8 Drawing Sheets

(56) References Cited

U.S. PATENT DOCUMENTS

| | | | | |
|---|---|---|---|---|
| 10,680,341 | B1 | 6/2020 | Anderson et al. | |
| 2013/0033404 | A1 | 2/2013 | Abe | |
| 2013/0321089 | A1 | 12/2013 | Ohashi et al. | |
| 2016/0254579 | A1 | 9/2016 | Mills | |
| 2020/0127358 | A1 | 4/2020 | de Rijk et al. | |
| 2020/0161738 | A1 | 5/2020 | de Rijk et al. | |
| 2020/0194860 | A1 | 6/2020 | Hollenbeck et al. | |
| 2021/0126332 | A1* | 4/2021 | Uemichi ..... | H01P 1/2088 |

FOREIGN PATENT DOCUMENTS

| | | | |
|---|---|---|---|
| WO | 2017203568 | A1 | 11/2017 |
| WO | 2020106774 | A1 | 5/2020 |

* cited by examiner

IRREGULAR HEXAGON CROSS-SECTIONED HOLLOW METAL WAVEGUIDE FILTERS

CROSS-REFERENCE TO RELATED APPLICATIONS

This application claims the benefit under 35 U.S.C. § 119(e) of U.S. Provisional Patent Application No. 62769,505 filed Nov. 19, 2018 and titled "IRREGULAR HEXAGON CROSS-SECTIONED HOLLOW METAL WAVEGUIDE FILTERS," which is incorporated herein by reference in its entirety, including but not limited to those portions that specifically appear hereinafter, the incorporation by reference being made with the following exception: In the event that any portion of the above-referenced application is inconsistent with this application, this application supersedes said above-referenced application.

TECHNICAL FIELD

The disclosure relates generally to systems, methods, and devices related to a waveguide filter and its construction. A waveguide filter may be a structure that receives an electromagnetic wave, or signal, and which allows the electromagnetic wave to propagate through the waveguide with minimal energy loss at a certain frequency or within a certain frequency band. Waveguides filters may be used in a host of contexts, examples of which include antennas, electromagnetic filters, and other radio frequency (RF) components.

BACKGROUND

Antennas are ubiquitous in modern society and are becoming an increasingly important technology as smart devices multiply and wireless connectivity moves into exponentially more devices and platforms. An antenna structure designed for transmitting and receiving signals wirelessly between two points can be as simple as tuning a length of a wire to a known wavelength of a desired signal frequency. At a particular wavelength (which is inversely proportional to the frequency by the speed of light $\lambda=c/f$) for a particular length of wire, the wire will resonate in response to being exposed to the transmitted signal in a predictable manner that makes it possible to "read" or reconstruct a received signal. For simple devices, like radio and television, a wire antenna serves well enough.

Passive antenna structures are used in a variety of different applications. Communications is the most well-known application, and applies to areas such as radios, televisions, and internet. Radar is another common application for antennas, where the antenna, which can have a nearly equivalent passive radiating structure to a communications antenna, is used for sensing and detection. Common industries where radar antennas are employed include weather sensing, airport traffic control, naval vessel detection, and low earth orbit imaging. A wide variety of high-performance applications exist for antennas that are less known outside the industry, such as electronic warfare and ISR (information, surveillance, and reconnaissance) to name a couple.

High performance antennas are required when high data rate, long range, or high signal to noise ratios are required for a particular application. In order to improve the performance of an antenna to meet a set of system requirements, for example on a satellite communications (SATCOM) antenna, it is desirable to reduce the sources of loss and increase the amount of energy that is directed in a specific area away from the antenna (referred to as 'gain'). In the most challenging applications, high performance must be accomplished while also surviving demanding environmental, shock, and vibration requirements. Losses in an antenna structure can be due to a variety of sources: material properties (losses in dielectrics, conductivity in metals), total path length a signal must travel in the passive structure (total loss is loss per length multiplied by the total length), multi-piece fabrication, antenna geometry, and others. These are all related to specific design and fabrication choices that an antenna designer must make when balancing size, weight, power, and cost performance metrics (SWaP-C). Gain of an antenna structure is a function of the area of the antenna and the frequency of operation. To create a high gain antenna is to increase the total area with respect to the number of wavelengths, and poor choice of materials or fabrication method can rapidly reduce the achieved gain of the antenna by increasing the losses in the passive feed and radiating portions.

One of the lowest loss and highest performance RF structures is hollow metal waveguide. This is a structure that has a cross section of dielectric, air, or vacuum which is enclosed on the edges of the cross section by a conductive material, typically a metal like copper or aluminum. Typical cross sections for hollow metal waveguide include rectangles, squares, and circles, which have been selected due to the ease of analysis and fabrication in the $19^{th}$ and $20^{th}$ centuries. Air-filled hollow metal waveguide antennas and RF structures are used in the most demanding applications, such as reflector antenna feeds and antenna arrays. Reflector feeds and antenna arrays have the benefit of providing a very large antenna with respect to wavelength, and thus a high gain performance with low losses.

Every physical component is designed with the limitations of the fabrication method used to create the component. Antennas and RF components are particularly sensitive to fabrication method, as the majority of the critical features are inside the part, and very small changes in the geometry can lead to significant changes in antenna performance. Due to the limitations of traditional fabrication processes, hollow metal waveguide antennas and RF components have been designed so that they can be assembled as multi-piece assemblies, with a variety of flanges, interfaces, and seams. All of these junctions where the structure is assembled together in a multi-piece fashion increase the size, weight, and part count of a final assembly while at the same time reducing performance through increased losses, path length, and reflections. This overall trend of increased size, weight, and part count with increased complexity of the structure have kept hollow metal waveguide antennas and RF components in the realm of applications where size, weight, and cost are less important than overall performance.

Accordingly, conventional waveguides have been manufactured using conventional subtractive manufacturing techniques which limit specific implementations for waveguides to the standard rectangular, square, and circular cross-sectional geometries that have the limitations described above. Additive manufacturing techniques provide opportunities, such as integrating waveguide structures with other RF components such that a plurality of RF components may be formed in a smaller physical device with improved overall performance. However, the process of fabricating a traditional rectangular, square, or circular waveguide structure in additive manufacturing typically leads to suboptimal performance and increased total cost in integrated waveguide structures. Novel cross-sections for waveguide structures that take advantage of the strengths of additive manufacturing will allow for improved performance of antennas and RF components while reducing total cost for a complex assembly.

It is therefore one object of this disclosure to provide waveguide filter structures that may be optimally fabricated with three dimensional printing techniques (aka additive manufacturing techniques). It is a further object of this disclosure to provide waveguide filter structures that are joined to create different types of filters. It is a further object of this disclosure to provide waveguide filter structures that are integral with other RF components.

SUMMARY

Disclosed herein is a waveguide filter that includes a fundamental waveguide unit. The fundamental waveguide unit may have an irregular hexagonal metal structure. One wall of the irregular hexagonal metal structure may be connected to one or more walls of another fundamental waveguide unit having an irregular hexagonal metal structure.

Further disclosed herein is a fundamental waveguide unit which may include a hollow irregular hexagonal metal structure which includes a resonant cavity that receives an electromagnetic signal and propagates the signal through the resonant cavity.

BRIEF DESCRIPTION OF THE DRAWINGS

Non-limiting and non-exhaustive implementations of the present disclosure are described with reference to the following figures, wherein like reference numerals refer to like parts throughout the various views unless otherwise specified. Advantages of the present disclosure will become better understood with regard to the following description and accompanying drawings where.

DETAILED DESCRIPTION

Figure 1:
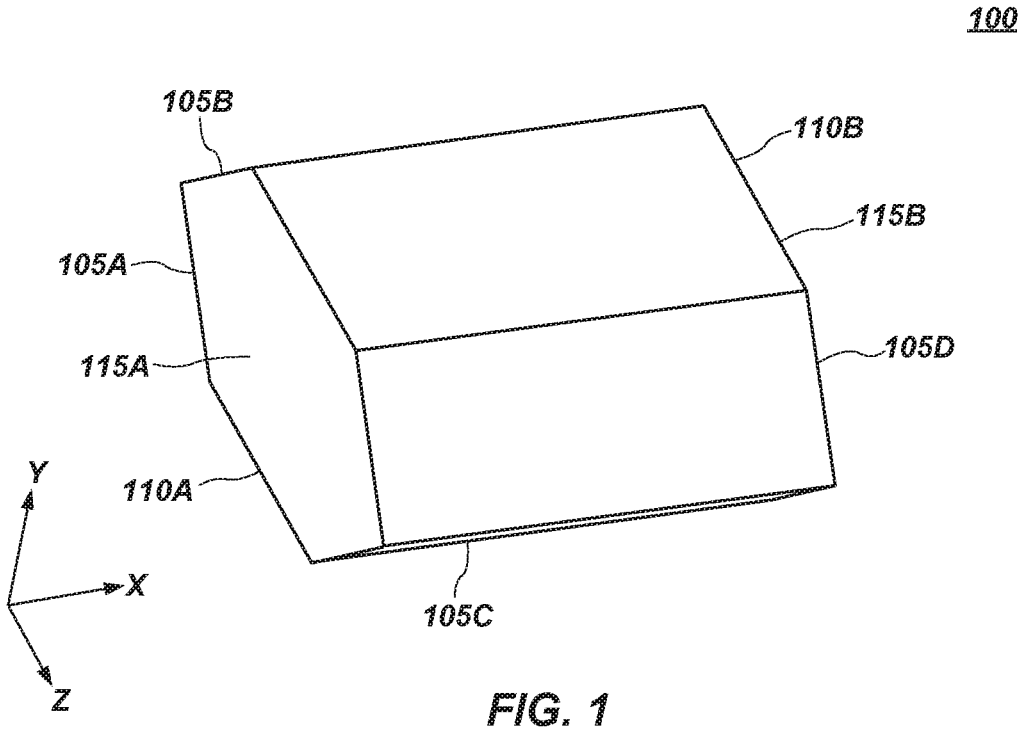
FIG. 1 illustrates an embodiment of an air volume of an irregular hexagonal waveguide cavity.

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Before the structure, systems, and methods for integrated marketing are disclosed and described, it is to be understood that this disclosure is not limited to the particular structures, configurations, process steps, and materials disclosed herein as such structures, configurations, process steps, and materials may vary somewhat. It is also to be understood that the terminology employed herein is used for the purpose of describing particular embodiments only and is not intended to be limiting since the scope of the disclosure will be limited only by the appended claims and equivalents thereof.

In describing and claiming the subject matter of the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the phrase "consisting of" and grammatical equivalents thereof exclude any element or step not specified in the claim.

As used herein, the phrase "consisting essentially of" and grammatical equivalents thereof limit the scope of a claim to the specified materials or steps and those that do not materially affect the basic and novel characteristic or characteristics of the claimed disclosure.

It is also noted that many of the figures discussed herein show air volumes of various implementations of waveguides, waveguide components, and/or waveguide transitions. In other words, these air volumes illustrate negative spaces of the components within a fabricated element which are created by a metal skin installed in the fabricated element, as appropriate to implement the functionality described. It is to be understood that positive structures that create the negative space shown by the various air volumes are disclosed by the air volumes, the positive structures including a metal skin and being formed using the additive manufacturing techniques disclosed herein.

For the purposes of this description as it relates to a metal additive manufacturing system, the direction of growth over time is called the positive z-axis, or "zenith" while the opposite direction is the negative z-axis or "nadir." The nadir direction is sometimes referred to as "downward" although the orientation of the z-axis relative to gravity makes no difference in the context of this invention. The direction of a surface at any given point is denoted by a vector that is normal to that surface at that point. The angle between that vector and the negative z-axis is the "overhang angle," θ ("theta").

The term "downward facing surface" is any non-vertical surface of an object being fabricated in a metal additive manufacturing process that has an overhang angle, θ, measured between two vectors originating from any single point on the surface. The two vectors are: (1) a vector perpendicular to the surface and pointing into the air volume and (2) a vector pointing in the nadir (negative z-axis, opposite of the build, or zenith) direction. An overhang angle, θ, for a downward facing surface will generally fall within the range: $0° \leq \theta < 90°$. Overhang angles, θ, for downward facing surfaces are illustrated in various embodiments of hollow metal waveguides, as further described below. As used herein, downward facing surfaces are unsupported by removable support structures from within a waveguide during fabrication, for example, which means that no internal bracing exists within a cavity of a waveguide for supporting downward facing surfaces or build walls.

FIG. 1 illustrates an embodiment of a cross section of an irregular hexagonal waveguide 100 which also may be referred to as a waveguide unit in terms of being combined in various ways that will be described below with other waveguide units. Waveguide 100 includes a plurality of walls or sides. As shown in FIG. 1, waveguide 100 includes a first wall 105A and a second wall 105B which are symmetric with identical lengths. Waveguide 100 further includes a third wall 105C and a fourth wall 105D which are also symmetric with identical lengths. As shown in FIG. 1, each of walls 105A-105D are symmetric with identical lengths. However, walls 105A-105D need not be symmetric or have identical lengths and may be altered or adjusted to better suit a particular set of electrical characteristic design requirements. Each of walls 105A-105D may have different lengths or some of walls 105A-105D may have similar lengths while others of walls 105A-105D may have different lengths.

Waveguide 100 is referred to as an irregular hexagonal in three dimensions because fifth wall 110A and sixth wall 110B have a length that is different from walls 105A-105D. Waveguide 100 may be extruded from a cross section (e.g., a cross section oriented on an YZ axis) to a certain width (e.g., from an origin of a set of cartesian coordinates in a X direction, as shown in FIG. 1). As shown in FIG. 1, fifth wall 110A and sixth wall 110B have a same length that is longer than a length of wall 105A-105D. Although, it is conceivable, that fifth wall 110A and sixth wall 110B may have a length that is the same as or shorter than a length of wall 105A-105D. It should be noted that in the special case where fifth wall 110A and sixth wall 110B have a length that is the same as a length of walls 105A-105D, waveguide 100 may be a regular hexagonal waveguide in three dimensions. The term "hexagonal" as used herein, may include both irregular or regular hexagonal waveguides while the term "irregular hexagon" or "regular hexagon" excludes a regular hexagon or irregular hexagon, respectively.

Waveguide 100 may include a resonant cavity which begins at cross section 115A and ends at cross section 115B, as shown in the example of FIG. 1. Waveguide 100 may be implemented as the resonant cavity which allows an electromagnetic signal to resonate at a specific center frequency within the length of waveguide 100. Waveguide 100 may, for this reason, also be considered a waveguide cavity that may be disposed within an electronic component or may be referred to as a "fundamental waveguide unit" of a waveguide filter, as will be discussed below. Waveguide 100 supports a first waveguide mode (e.g., a $TE_{101}$ mode).

Waveguide 100 has many advantages over conventional waveguides. First, waveguide 100 may provide suitable electrical characteristics for receiving a signal of comparable frequency, power, transmission loss, and other electrical characteristics as, for example, conventional rectangular waveguides. However, waveguide 100 may be more easily created using metal additive manufacturing processes (e.g., 3D metal printing) than, for example, conventional rectangular waveguides.

Metal additive manufacturing is a fabrication method that allows for complex integrated structures to be fabricated as a single part. However, one unique aspect of metal additive manufacturing, is that these complex integrated structures are fabricated as layers laid on top of other layers of metal. Thus, orientation, or printing order, of specific parts or pieces must be considered to ensure that a hollow metal waveguide, or other structure, may be formed within an integrated structure without additional build support within the waveguide. In other words, during metal additive manufacturing, only a first layer of metal may be printed without having another layer underneath the first layer preferably in a positive Z-direction (e.g., from approximately 0° to approximately 90° to the X-Y plane). This is possible by printing onto a build plate to support the build of a structure in, preferably, a positive Z-direction in a typical metal additive manufacturing build process. Further, another constraint of metal additive manufacturing is that a metal layer must be printed on another layer of metal (or build substrate in the case of the first metal layer). In one example, a rectangular waveguide may have four sides, a bottom, two vertical sides, and a top. Printing a rectangular waveguide, however, presents difficulties because, while the bottom and vertical sides may be easily printed, the top side of the rectangular waveguide must be printed without a layer of material underneath it. Thus, any new layer has no metal layer on which to print a top side of the rectangular waveguide. In order to print a top surface, at least some overhang from a previous layer, must extend, at least on a micron level, across a gap between the vertical sides of the rectangular waveguide in order to eventually join the vertical sides with a top side. While some overhang can be tolerated, an overhang of 0°, or a right-angle, as in a rectangular waveguide, typically leads to mechanical defects or requires internal support structures to fabricate.

Overhang generated during the layering of an additive manufacturing fabrication at transitions with angles at or near 0° can produce significant mechanical defects. Such overhang tends to occur at locations where one or more walls of the component being manufactured encounters a significant transition (e.g., an angle approaching 0°) in the build direction. Therefore, it is desirable to maintain the angles between different surfaces within a prescribed range of 45° +/±25° through selective component shaping and build orientation during manufacturing. Waveguide 100 provides a waveguide with angles that have more moderate transition angles between each one of walls 105A-105D and with fifth wall 110A and sixth wall 110B. It is noted that first wall 105A and second wall 105B may be supported by metal and only third wall 105C and fourth wall 105D are considered to be overhanging sides.

In some embodiments, print orientation of the various embodiments of waveguides disclosed herein is generally along the positive z-axis direction, which is a presently preferred orientation for the waveguides, and which also tends to minimize overhang. As such, an irregular hexagonal-shaped cross-section of waveguide 100 is a useful geometry for both the electrical characteristics required for a waveguide, but also for printing by additive manufacturing techniques. Waveguide 100 minimizes build volume of more complex waveguide assemblies while also reducing overhang issues by keeping critical overhang angles controlled to 45°±25°. For example, short walls are chamfered on each corner by a nominal 45° angle such that waveguide 100 comes to a point between any of walls 105A-105D and walls 110A-110B. Symmetry of waveguide 100 (chamfers on upper and lower edge) may be employed for improved RF performance and routing.

Figure 2:
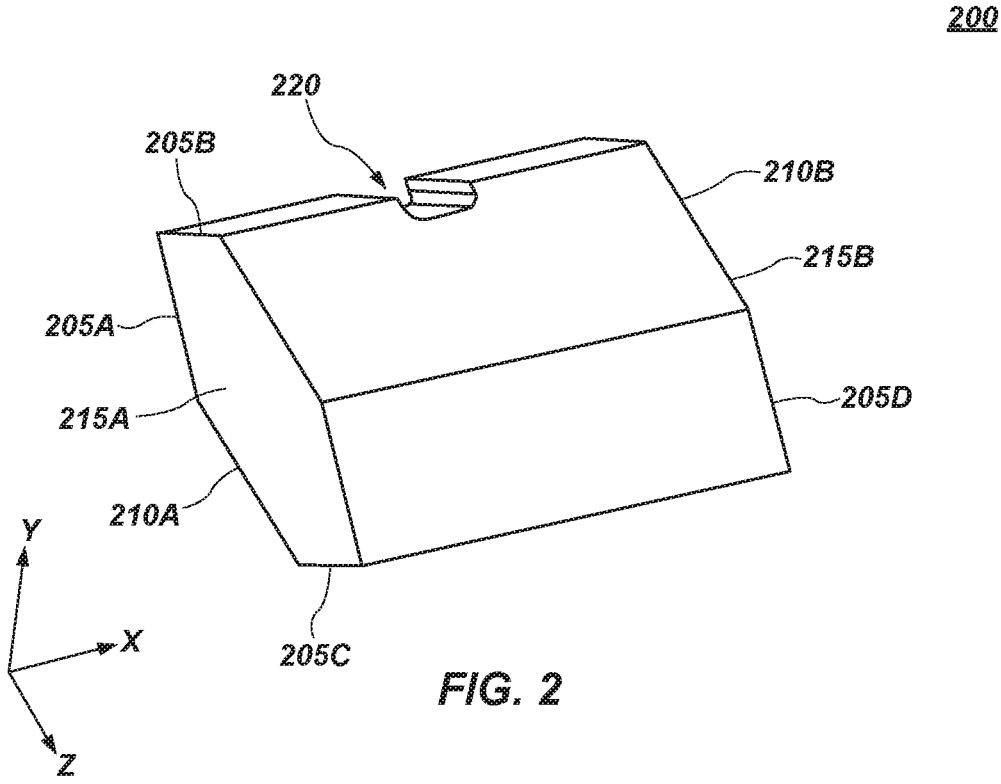
FIG. 2 illustrates an embodiment of an air volume of an irregular hexagonal waveguide cavity with a resonance indent.

FIG. 2 illustrates an embodiment of an air volume of an irregular hexagonal waveguide cavity or unit 200 with a resonance indent 220. Waveguide 200 includes a plurality of walls or sides. As shown in FIG. 2, waveguide 200 includes a first wall 205A and a second wall 205B which are symmetric with identical lengths. Waveguide 200 further includes a third wall 205C and a fourth wall 205D which are also symmetric with identical lengths. As shown in FIG. 2, each of walls 205A-205D are symmetric with identical lengths. However, walls 205A-205D need not be symmetric or have identical lengths and may be altered or adjusted to better suit a particular set of electrical characteristic design requirements. Each of walls 205A-205D may have different lengths or some of walls 205A-205D may have similar lengths while others of walls 205A-205D may have different lengths. Waveguide 200 supports a first waveguide mode (e.g., a $TE_{101}$ mode).

Waveguide 200 is referred to as an irregular hexagonal in three dimensions because fifth wall 210A and sixth wall 210B have a length that is different from walls 205A-205D. Waveguide 200 may be extruded from a cross section (e.g., a cross section oriented on an YZ axis) to a certain width (e.g., from an origin of a set of cartesian coordinates in a X direction, as shown in FIG. 2). As shown in FIG. 2, fifth wall 210A and sixth wall 210B have a same length that is longer than a length of wall 205A-205D. Although, it is conceivable, that fifth wall 210A and sixth wall 210B may have a length that is the same as or shorter than a length of wall 205A-205D. It should be noted that in the special case where fifth wall 210A and sixth wall 210B have a length that is the same as a length of walls 205A-205D, waveguide 200 may be a regular hexagonal waveguide in three dimensions. The term "hexagonal" as used herein, may include both irregular or regular hexagonal waveguides while the term "irregular hexagon" or "regular hexagon" excludes a regular hexagon or irregular hexagon, respectively.

Waveguide 200 further includes a resonance indent 220. It is noted that FIG. 2 illustrates an air volume of waveguide 200 rather than a metal implementation of waveguide 200 a metal implementation of waveguide 200 would obscure the features of the waveguide in the figure. However, when waveguide 200 is implemented in a metal skin, for example, resonance indent 220 may in practice be implemented as a projection or an outdent in the metal. The term "resonance indent" is intended to mean both an indent in an air volume and a projection in a physical implementation. Resonance indent 220, as shown in FIG. 2, is positioned within a first wall 205A and second wall 205B centering on an approximate midpoint of first wall 205A and second wall 205B. However, resonance indent 220 may be positioned on third wall 205C and fourth wall 205D to suit a particular intended implementation. Resonance indent 220 operates as a notch in a sidewall of waveguide 200 in a manner that is perpendicular to an axis defined by the resonant cavity beginning at cross section 215A and ending at cross section 215B, as discussed below. Resonance indent 220, in practical implementation, increases the resonant frequency of waveguide 200 and the accompanying electric field. Resonance indent 220 may also be implemented with rounded edges to facilitate formation through metal additive manufacturing without the use of build supports.

Waveguide 200 may include a resonant cavity which begins at cross section 215A and ends at cross section 215B, as shown in the example of FIG. 2. Waveguide 200 may be implemented as the resonant cavity which allows an electromagnetic signal to resonate at a specific center frequency within the length of waveguide 200. Waveguide 200 may, for this reason, also be considered a waveguide cavity that may be disposed within an electronic component or a "fundamental waveguide unit" of a waveguide filter, as will be discussed below.

Figure 3:
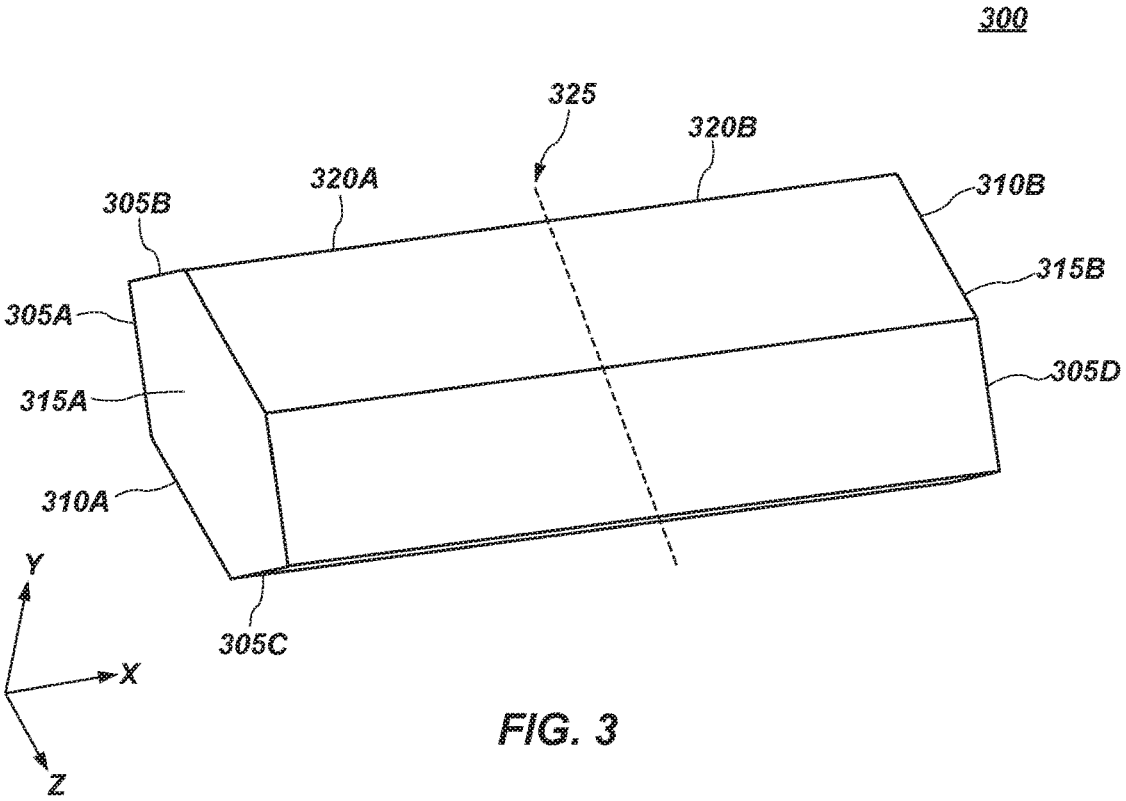
FIG. 3 illustrates an embodiment of an air volume of an irregular hexagonal waveguide cavity.

FIG. 3 illustrates an embodiment of an air volume of an irregular hexagonal waveguide 300. Waveguide 300 includes a plurality of walls or sides. As shown in FIG. 3, waveguide 300 includes a first wall 305A and a second wall 305B which are symmetric with identical lengths. Waveguide 300 further includes a third wall 305C and a fourth wall 305D which are also symmetric with identical lengths. As shown in FIG. 3, each of walls 305A-305D are symmetric with identical lengths. However, walls 305A-305D need not be symmetric or have identical lengths and may be altered or adjusted to better suit a particular set of electrical characteristic design requirements. Each of walls 305A-305D may have different lengths or some of walls 305A-305D may have similar lengths while others of walls 305A-305D may have different lengths.

Waveguide 300 is referred to as an irregular hexagonal in three dimensions because fifth wall 310A and sixth wall 310B have a length that is different from walls 305A-305D. Waveguide 300 may be extruded from a cross section (e.g., a cross section oriented on an YZ axis) to a certain width (e.g., from an origin of a set of cartesian coordinates in a X direction, as shown in FIG. 1). As shown in FIG. 3, waveguide 300 is shown as having approximately twice the length in the X axis as waveguide 100, shown in FIG. 1, to support another waveguide mode (e.g., a $TE_{102}$ mode), as will be described below.

As shown in FIG. 3, fifth wall 310A and sixth wall 310B have a same length that is longer than a length of wall 305A-305D. Although, it is conceivable, that fifth wall 310A and sixth wall 310B may have a length that is the same as or shorter than a length of wall 305A-305D. It should be noted that in the special case where fifth wall 310A and sixth wall 310B have a length that is the same as a length of walls 305A-305D, waveguide 300 may be a regular hexagonal waveguide in three dimensions. The term "hexagonal" as used herein, may include both irregular or regular hexagonal waveguides while the term "irregular hexagon" or "regular hexagon" excludes a regular hexagon or irregular hexagon, respectively.

Waveguide 300 may include a resonant cavity which begins at cross section 315A and ends at cross section 315B, as shown in the example of FIG. 3. Waveguide 300 may be implemented as the resonant cavity which allows an electromagnetic signal to resonate at a specific center frequency within the length of waveguide 300. Waveguide 300 may, for this reason, also be considered a waveguide cavity that may be disposed within an electronic component. As previously discussed, waveguide 300 may be implemented as, for example, twice of the length in a X direction as waveguide 100, shown in FIG. 1, which is identified by a centerline 325 which divides waveguide 300 into two fundamental waveguide units 320A and 320B, as will be discussed below. As shown in FIG. 3, waveguide 300 is continuous throughout waveguide 300 and uninterrupted along a length of waveguide 300 (e.g., a resonant cavity of waveguide 300).

The extended length of waveguide 300 supports a waveguide mode that is different from a waveguide mode supported by waveguide 100, shown in FIG. 1. Waveguide 300 may be used in place of or in conjunction with waveguide 100, shown in FIG. 1 to aid in design or to implement a shift in the transmission zero location from above the passband to below the passband. Further, waveguide 300 may be used in triplet or filter configurations, which will be discussed below and may provide additional desirable electrical characteristics, such increased flexibility in filter design for placing transmission zeros within the rejection band of a filter.

Figure 4:
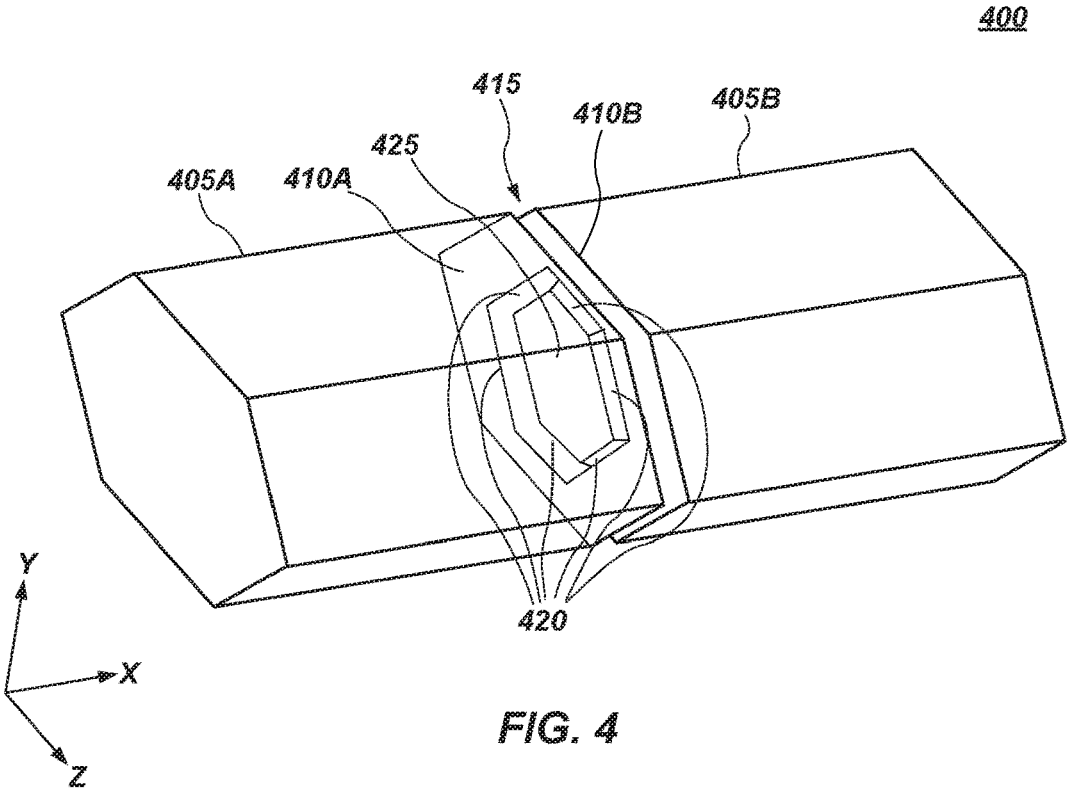
FIG. 4 illustrates an embodiment of an air-volume of a sidewall coupling for an irregular hexagonal waveguide cavity.

FIG. 4 illustrates an embodiment of an air-volume of a sidewall coupling for an irregular hexagonal waveguide 400. Waveguide 400 may be implemented as a cavity which includes a first fundamental waveguide unit 405A and a second fundamental waveguide unit 405B which may be joined together by a connection referred to as a sidewall connection. First fundamental waveguide unit 405A and second fundamental waveguide unit 405B may be similar to waveguide 100, shown in FIG. 1 in terms of outer walls. However, first fundamental waveguide unit 405A, for example, includes an inside wall 410A which operates as a transition through junction 415 to second fundamental waveguide unit 405B. Inside wall 410A may be installed as a sidewall, which may be installed in a position that is similar to a location of cross section 115B, shown in FIG. 1. Second fundamental waveguide unit 405B may be similarly fashioned, although inside wall 410B of waveguide unit 405B may be installed in a position that is similar to a location of cross section 115A, shown in FIG. 1.

As shown in FIG. 4, junction 415 is implemented between inside wall 410A of first fundamental waveguide unit 405A and inside wall 410B of second fundamental waveguide unit 405B. Junction 415 is installed as a plurality of rounded edge transitions 420 which surround propagation channel aperture 425, also referred to as an iris, between first fundamental waveguide unit 405A and second fundamental waveguide unit 405B. Propagation channel aperture 425 may also be implemented as an irregular hexagonal shaped opening albeit of a reduced diameter as compared to, for example, a propagation channel of waveguide 100, shown in FIG. 1. Rounded edge transitions 420 operate to provide a contiguous and smooth narrowing of propagation channel aperture 425 in a manner that separates first fundamental waveguide unit 405A from second fundamental waveguide unit 405B by a thickness that is defined by junction 415. Rounded edge transitions 420 also facilitate fabrication of waveguide 400 by metal additive manufacturing fabrication without the use of build supports.

Figure 5:
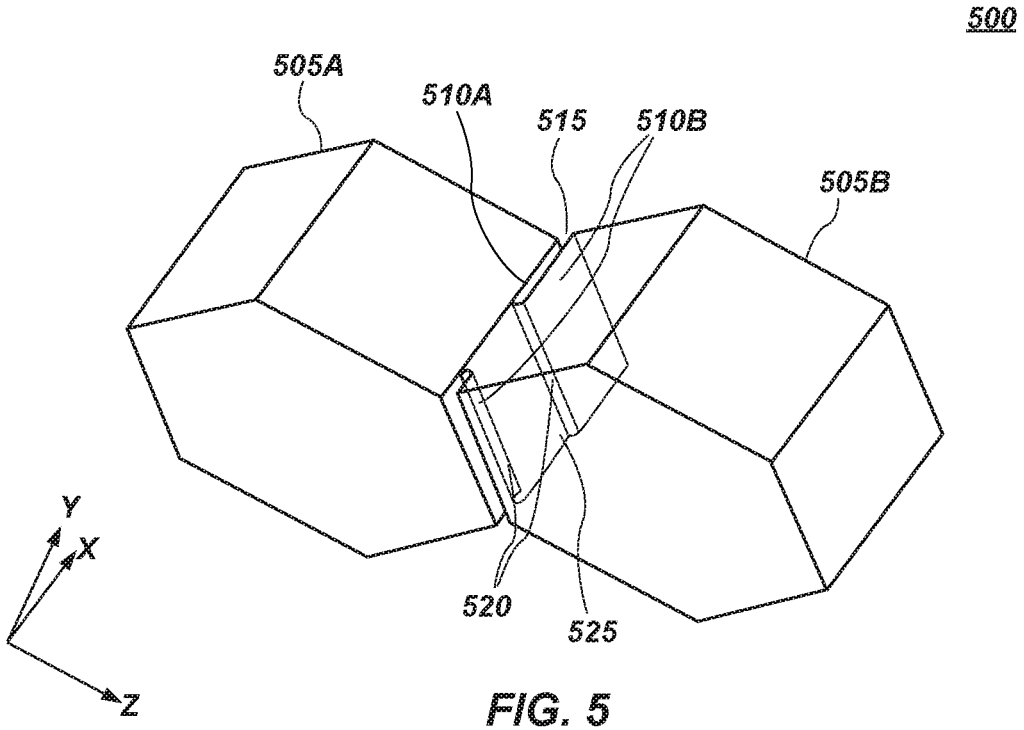
FIG. 5 illustrates another embodiment of an air volume of an irregular hexagonal waveguide with sidewall coupling.

FIG. 5 illustrates another embodiment of an air-volume of a sidewall coupling for an irregular hexagonal waveguide 500. Waveguide 500 may be implemented as a cavity which includes a first fundamental waveguide unit 505A and a second fundamental waveguide unit 505B which may be joined together by a connection referred to as a sidewall connection. First fundamental waveguide unit 505A and second fundamental waveguide unit 505B may be similar to waveguide 100, shown in FIG. 1 in terms of outer walls. However, first fundamental waveguide unit 505A, for example, includes inside walls 510A which operates as a transition through junction 515 to inside walls 510B of second fundamental waveguide unit 505B. Inside walls 510A and 510B may both be respectively disposed in two sections, having an aperture propagation channel aperture 525 disposed therebetween. Inside walls 510A may be joined to inside walls 510B at junction 515 and may include rounded edge transitions 520, which in this implementation, are rounded to facilitate a continuous and smooth transition between first fundamental waveguide unit 505A and second fundamental waveguide unit 505B. First fundamental waveguide unit 505A and second fundamental waveguide unit 505B may be joined by junction 515 at a sidewall, which may be installed along a wall designated as wall 105D of waveguide 100, shown in FIG., 1 for first fundamental waveguide unit 505A and wall 105A of waveguide 100, shown in FIG. 1, for second fundamental waveguide unit 505B. Any sidewall connection between one of designated walls 105A-105D of waveguide 100, shown in FIG. 1 may be joined with another one of designated walls 105A-105D of waveguide 100, shown in FIG. 1 in the manner shown in FIG. 5 with first fundamental waveguide unit 505A and second fundamental waveguide unit 505B.

As shown in FIG. 5, junction 515 is implemented between inside wall 510A of first fundamental waveguide unit 505A and inside wall 510B of second fundamental waveguide unit 505B. Junction 515 is installed as a plurality of rounded edge transitions 520 which surround propagation channel aperture 525, also referred to as an iris, between fundamental waveguide unit 510A and fundamental waveguide unit 510B. Propagation channel aperture 525 may also be implemented as a rectangular shaped opening, the size of which may be determined by inside walls 510A and 51B of first fundamental waveguide unit 505A and second fundamental waveguide unit 505B. Rounded edge transitions 520 operate to provide a contiguous and smooth narrowing of propagation channel aperture 525 in a manner that separates first fundamental waveguide unit 505A from second fundamental waveguide unit 505B by a thickness that is defined by junction 515. Rounded edge transitions 520 also facilitate fabrication of waveguide 500 by metal additive manufacturing fabrication without the use of build supports.

Figure 6:
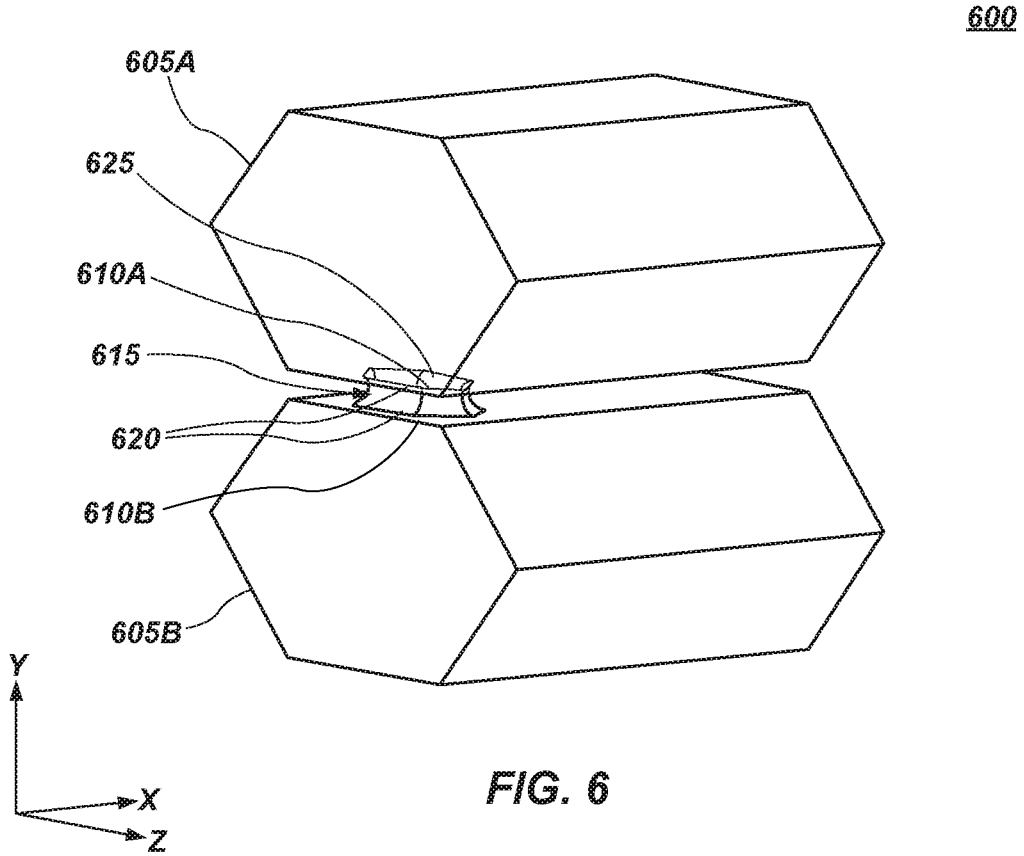
FIG. 6 illustrates an embodiment of an air volume of an irregular hexagonal waveguide with broadwall coupling.

FIG. 6 illustrates an embodiment of an air-volume of a broadwall coupling for an irregular hexagonal waveguide 600. Waveguide 600 may be implemented as a cavity which includes a first fundamental waveguide unit 605A and a second fundamental waveguide unit 605B which may be joined together by a connection referred to as a broadwall connection. First fundamental waveguide unit 605A and second fundamental waveguide unit 605B may be similar to waveguide 100, shown in FIG. 1 in terms of outer walls. However, first fundamental waveguide unit 605A, for example, includes an inside wall 610A which operates as a transition through junction 615 to second fundamental waveguide unit 605B. Junction 615 may connect through one of wall 110A and wall 110B of waveguide 100, shown in FIG. 1, and may also be referred to as broadwalls of first fundamental waveguide unit 605A. Thus, inside wall 610A of a broadwall of a first fundamental waveguide unit may connect to junction 615 in first fundamental waveguide unit 605A. Second fundamental waveguide unit 605B may be similarly fashioned, although inside wall 610B of second fundamental waveguide unit 605B may connect to junction 615 through one of wall 110A and wall 110B of waveguide 100 shown in FIG. 1, and may also be referred to as broadwalls of fundamental waveguide unit 610B.

As shown in FIG. 6, junction 615 is implemented between inside wall 610A of first fundamental waveguide unit 605A and inside wall 610B of fundamental waveguide unit 610B. Junction 615 is installed as a plurality of rounded edge transitions 620 which surround propagation channel aperture 625, also referred to as an iris, between fundamental waveguide unit 610A and fundamental waveguide unit 610B. Propagation channel aperture 625 may also be implemented as an irregular hexagonal shaped opening albeit of a reduced diameter as compared to, for example, a propagation channel of waveguide 100, shown in FIG. 1. Rounded edge transitions 620 operate to provide a contiguous and smooth narrowing of propagation channel aperture 625 in a manner that separates first fundamental waveguide unit 605A from second fundamental waveguide unit 605B by a thickness that is defined by junction 615. Rounded edge transitions 620 also facilitate fabrication of waveguide 600 by metal additive manufacturing fabrication without the use of build supports.

Figure 7:
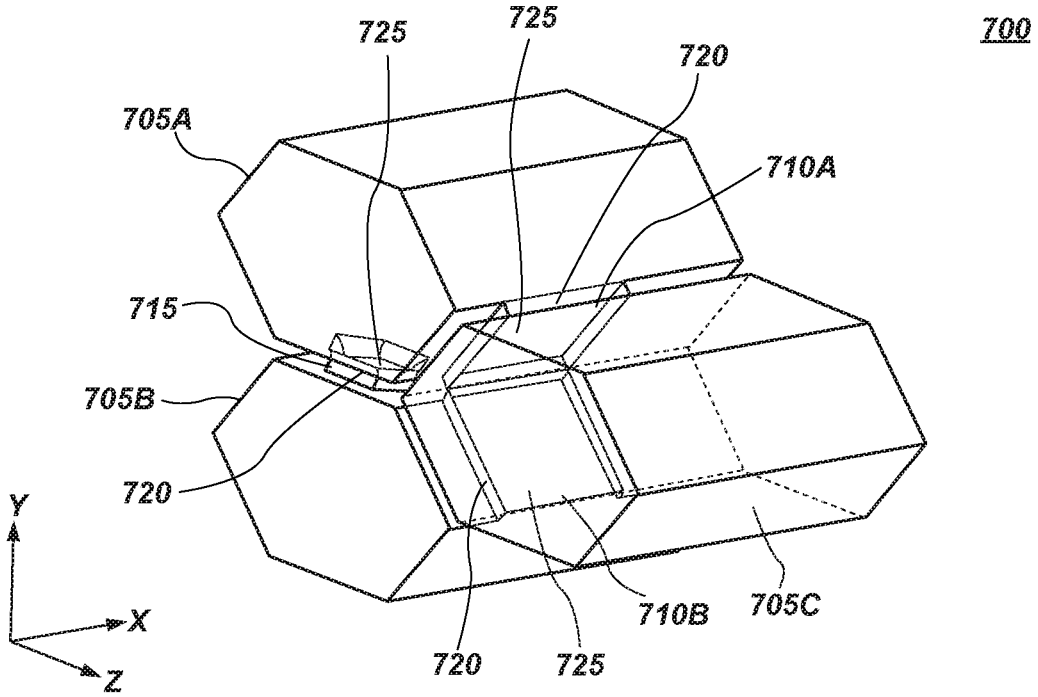
FIG. 7 illustrates an embodiment an air volume of an irregular hexagonal waveguide triplet.

FIG. 7 illustrates an embodiment of an air volume of an irregular hexagonal waveguide triplet 700. Waveguide triplet 700 may be implemented as a set of three resonant cavities which includes a first fundamental waveguide unit 705A, a second fundamental waveguide unit 705B, and third fundamental waveguide unit 705C which may be joined together using connections described above using transitions 720 around apertures 725, as shown in FIG. 7. For example, first fundamental waveguide unit 705A may be connected to second fundamental waveguide unit 705B by a broadwall junction 715, shown and described with respect to element 615 of FIG. 6, and connected to third fundamental waveguide unit 705C by a sidewall junction 710A, shown and described with respect to element 515 of FIG. 5. Second fundamental waveguide unit 705B may also be connected to third fundamental waveguide unit 705C by a sidewall junction 710B. The use of first fundamental waveguide unit 705A, a second fundamental waveguide unit 705B, and third fundamental waveguide unit 705C may be referred to as a "triplet" due to the use of three distinct cavities, one non-resonant cavity two resonant cavities (or three resonant cavities), which are connected with three sidewall or broadwall apertures. Creating a triplet 700 further serves to create an electromagnetic signal filter which allows certain ranges of frequencies in a particular signal to continue to propagate while other ranges of frequencies are blocked, or rejected, by the electromagnetic signal filter. As shown in FIG. 7, triplet 700 provides a transmission zero below a passband. In other words, triplet 700 is a filter that has improved filter rejection performance for frequencies in a signal that occur below a specified range of frequencies in a passband that are allowed to propagate through triplet 700.

Waveguide triplet 700, and other structures disclosed herein, may be printed using three dimensional printing techniques such as metal additive manufacturing processes. As shown, waveguide triplet 700, may be printed layer upon layer in a +Z direction from a build plate disposed on an XY axis of a cartesian coordinate system. Waveguide triplet 700, and other structures herein, are so oriented for to aid in fabrication of the structure without build supports.

Figure 8:
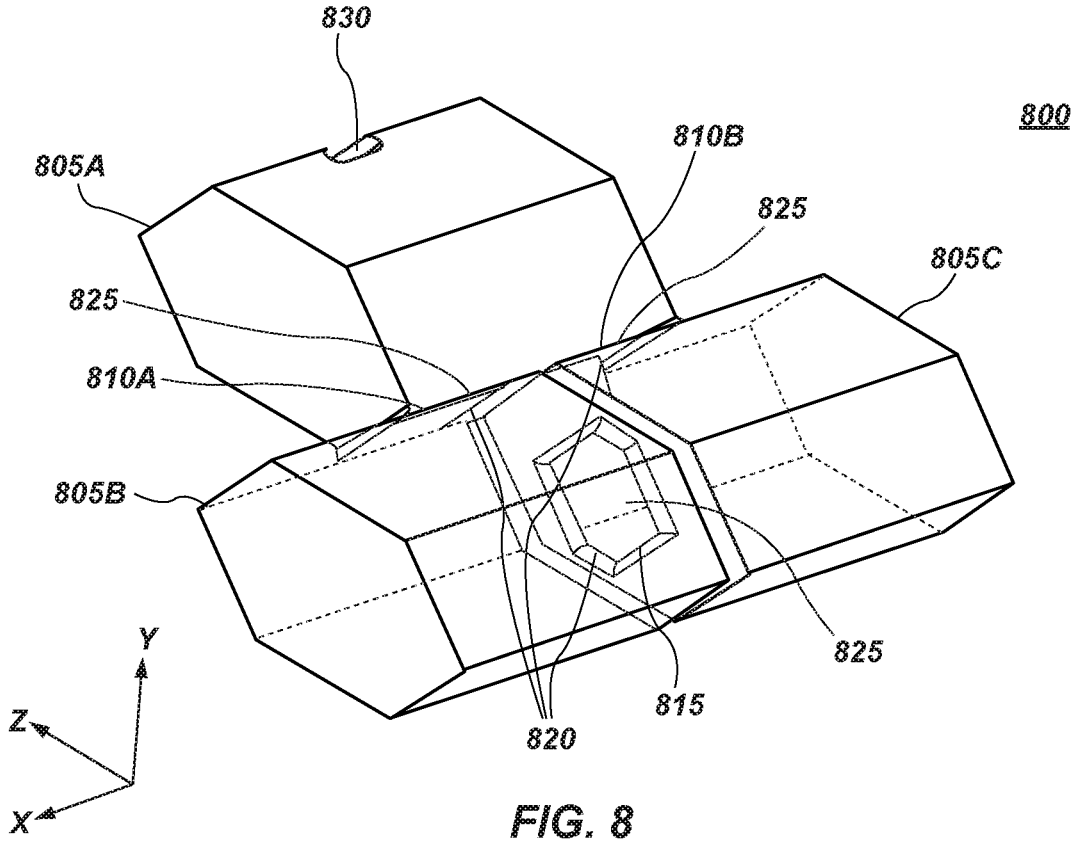
FIG. 8 illustrates an embodiment an air volume of a second irregular hexagonal waveguide triplet.

FIG. 8 illustrates an embodiment of an air volume of a second irregular hexagonal waveguide triplet 800. Waveguide triplet 800 may be implemented as a set of three resonant cavities which includes a first fundamental waveguide unit 805A, a second fundamental waveguide unit 805B, and third fundamental waveguide unit 805C which may be joined together using connections described above using transitions 820 around apertures 825, as shown in FIG. 8. For example, first fundamental waveguide unit 805A may be connected to second fundamental waveguide unit 805B by a first type of sidewall junction 810A and connected to third fundamental waveguide unit 805C by a second one of first type of sidewall junction 810B. First type of sidewall junctions 810A and 810B may be similar in description in implementation to junction 515, shown and described with respect to FIG. 5. Second fundamental waveguide unit 805B may also be connected to third fundamental waveguide unit 805C by a second type of sidewall junction 815. Second type of sidewall junction 815 may be similar in implementation and description to sidewall junction 415, shown and described with respect to FIG. 4. First fundamental waveguide unit 805A may further include a resonance indent 830, which may be similar in implementation and description to resonance indent 220, shown and described with respect to FIG. 2.

The use of first fundamental waveguide unit 805A, a second fundamental waveguide unit 805B, and third fundamental waveguide unit 805C may be referred to as a "triplet" due to the use of three cavities, one non-resonant cavity two resonant cavities (or three resonant cavities), which are connected with three sidewall or broadwall apertures. Creating a triplet 800 further serves to create an electromagnetic signal filter which allows certain ranges of frequencies in a particular signal to continue to propagate while other ranges of frequencies are blocked, or rejected, by the electromagnetic signal filter. As shown in FIG. 8, triplet 800 provides a transmission zero above a passband. In other words, triplet 800 is a filter that has improved filter rejection performance for frequencies in a signal that occur above a specified range of frequencies in a passband that are allowed to propagate through triplet 800.

Finally, it is noted with respect to FIGS. 7 and 8 that triplet 700 and triplet 800, shown in FIGS. 7 and 8 respectively are only two exemplary implementations of triplets that may be created using the techniques, junctions, features, and other elements disclosed herein. Multiple different types of triplets are contemplated which use broadwall and sidewall junctions, of various types, in distinct triplets. However, based on the disclosure above, one of ordinary skill in the art would appreciate that a significant number of iterations of different triplets with different types of connections are possible and, in fact, desirable in many purpose driven applications.

Figure 9:
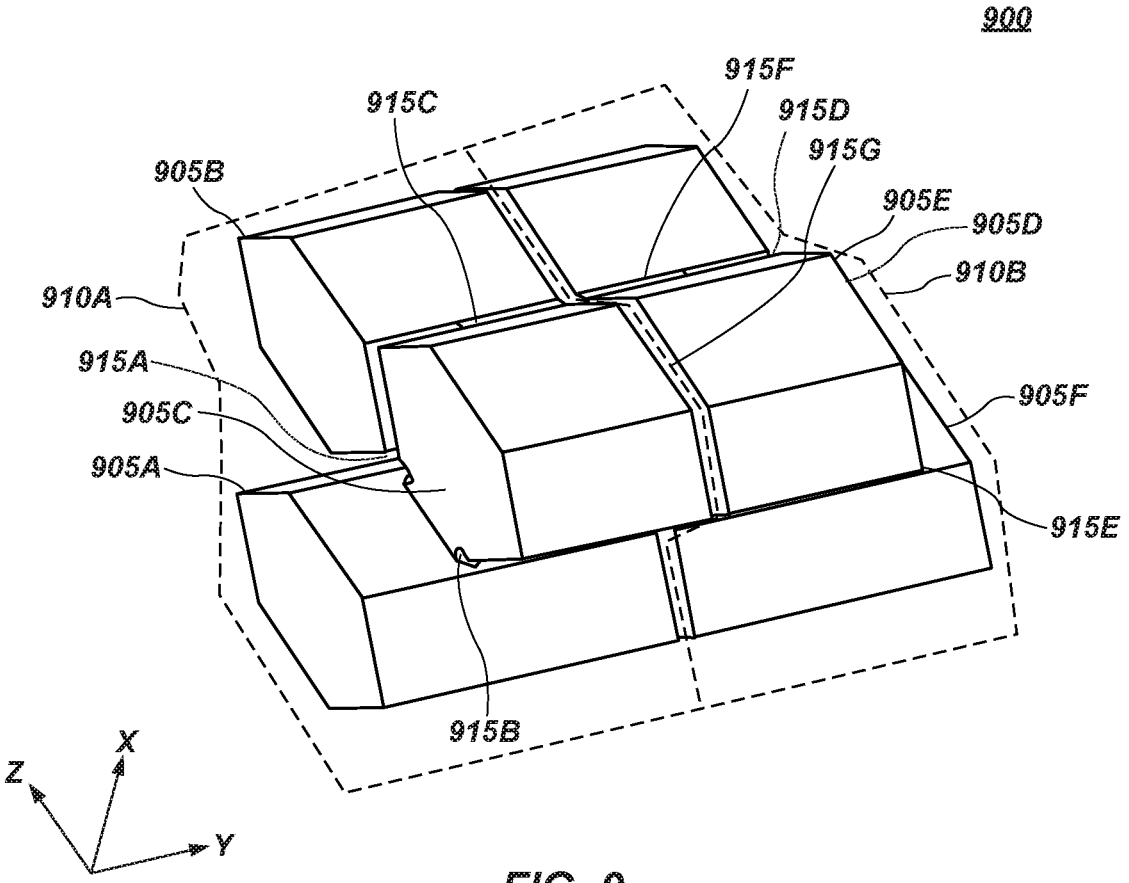
FIG. 9 illustrates an embodiment of an air volume of an irregular hexagonal waveguide including a first triplet combined with a second triplet.

FIG. 9 illustrates an embodiment of an air volume of an irregular hexagonal waveguide 900 including a first triplet 910A combined with a second triplet 910B. Waveguide 900 includes a waveguide 905A and a waveguide 905F which are the input and the output of the filter. Waveguide 905A and waveguide 905F may, therefore, be implemented as being longer waveguide sections than a fundamental waveguide unit as they are not a resonant cavity. Waveguide 900 further includes a first fundamental waveguide unit 905B, a second fundamental waveguide unit 905C, a third fundamental waveguide unit 905D, and a fourth fundamental waveguide unit 905E. First triplet 910A includes waveguide 905A, first fundamental waveguide unit 905B, and second fundamental waveguide unit 905C. Second triplet 910B includes waveguide 905F, third fundamental waveguide unit 905D and fourth fundamental waveguide unit 905E.

As shown in FIG. 9, waveguide 905A may act as an input for an electromagnetic signal while waveguide 905F may act as an output for a filtered electromagnetic signal, as waveguide 900 operates as a two triplet filter to achieve two transmission zeros below a passband. Alternatively, waveguide 905F may act as an input for an electromagnetic signal while waveguide 905A acts an output for the filtered electromagnetic signal. Further shown in FIG. 9 is a plurality of connections between the various waveguides 905A-905F. For example, as shown in FIG. 9, first triplet 910A may be implemented as a waveguide 905A and two resonant cavities, which are implemented as first fundamental waveguide unit 905B and second fundamental waveguide unit 905C. Waveguide 905A and fundamental waveguide units 905B and 905C may be joined together using connections described above. For example, waveguide 905A may be connected to first fundamental waveguide unit 905B by a sidewall junction 915A, shown and described with respect to element 515 of FIG. 5, and connected to second fundamental waveguide unit 905C by a broadwall junction 915B, shown and described with respect to element 615 of FIG. 6. First fundamental waveguide unit 905B may also be connected to third fundamental waveguide unit 905C by a sidewall junction 915C. The use of waveguide 905A, a second fundamental waveguide unit 905B, and third fundamental waveguide unit 905C may be referred to as a "triplet" due to the use of a waveguide with two resonant cavities.

Second triplet 910B may be implemented as a waveguide 905F and two resonant cavities, which are implemented as third fundamental waveguide unit 905D and fourth fundamental waveguide unit 905E. Waveguide 905F and fundamental waveguide units 905D and 905E may be joined together using connections described above. For example, waveguide 905F may be connected to third fundamental waveguide unit 905D by a sidewall junction 915D, shown and described with respect to element 515 of FIG. 5, and connected to fourth fundamental waveguide unit 905E by a broadwall junction 915E, shown and described with respect to element 615 of FIG. 6. Third fundamental waveguide unit 905D may also be connected to fourth fundamental waveguide unit 905E by a sidewall junction 915F. The use of first fundamental waveguide unit 905A, a second fundamental waveguide unit 905B, and third fundamental waveguide unit 905C may be referred to as a "triplet" due to the use of a waveguide with two resonant cavities.

First triplet 910A and second triplet 910B may further be interconnected. For example, waveguide 905A may be connected to second triplet 910B in various ways. As shown in FIG. 9, second fundamental waveguide unit 905C is connected to fourth fundamental waveguide unit 905E with a sidewall junction 915G, which may be similar in implementation and description to junction 415, shown and described with respect to FIG. 4.

Any of junctions 915A-915G may be implemented as sidewall junctions or broadwall junctions, which have been described above, to facilitate any particular implementation of waveguide 900. For example, as shown in FIG. 9, waveguide 900 provides two transmission zeros below a passband. In other words, waveguide 900 is a filter that has improved filtering performance for frequencies in a signal that occur below a specified range of frequencies in a passband that are allowed to propagate through waveguide 900. Implementing first triplet 910A and second triplet 910B provides for two transmission zeros below the passband to ensure that frequencies within a specified rejection band will have increased rejection due to complete cancellation of the electromagnetic energy at two prescribed frequencies which are set by the transmission zeros.

Figure 10:
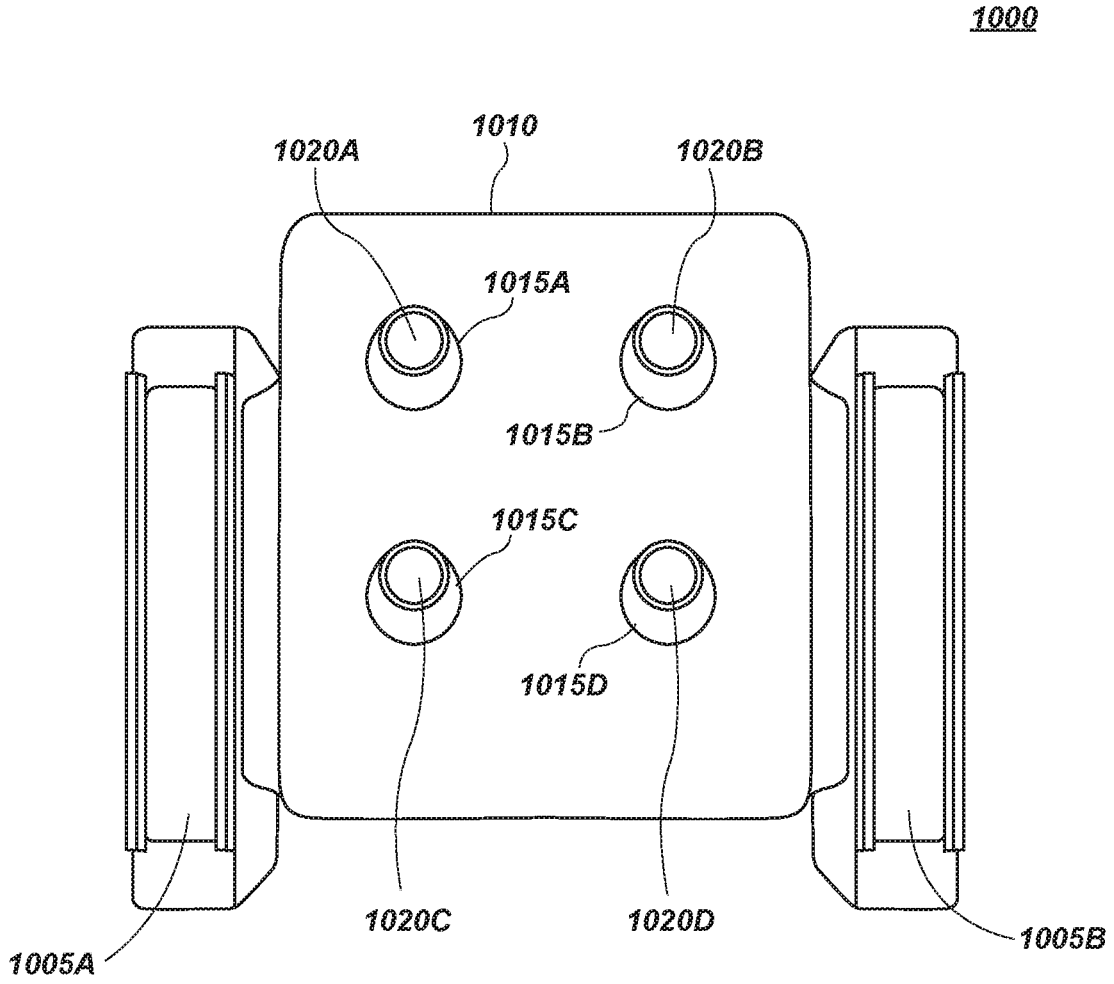
FIG. 10 illustrates a fabricated bandpass triplet filter.

FIG. 10 illustrates a fabricated bandpass triplet filter 1000, effectively implementing waveguide 900 as a fabricated component. Filter 1000 includes a waveguide input 1005A and a waveguide output 1005B with a plurality of waveguides implemented in a filter section 1010. Filter section 1010 may include, for example, waveguides 905B-905E, shown in FIG. 9 and may provide each one of waveguides 905B-905E with a tuning orifice 1015A-1015D and a tuning screw 1020A-1020D to make minor tuning adjustments to waveguides 905B-905E in filter section 1010.

Filter 1000 provides two transmission zeros below a passband. In other words, filter 1000 filters out frequencies in a signal that occur below a specified range of frequencies in a passband that are allowed to propagate through filter 1000. Implementing first triplet 910A and second triplet 910B, shown in FIG. 9, respectively, within filter 1000 provides for two transmission zeros below the passband to ensure that frequencies within a specified rejection band will have increased rejection due to complete cancellation of the electromagnetic energy at two prescribed frequencies which are set by the transmission zeros.

Figure 11:
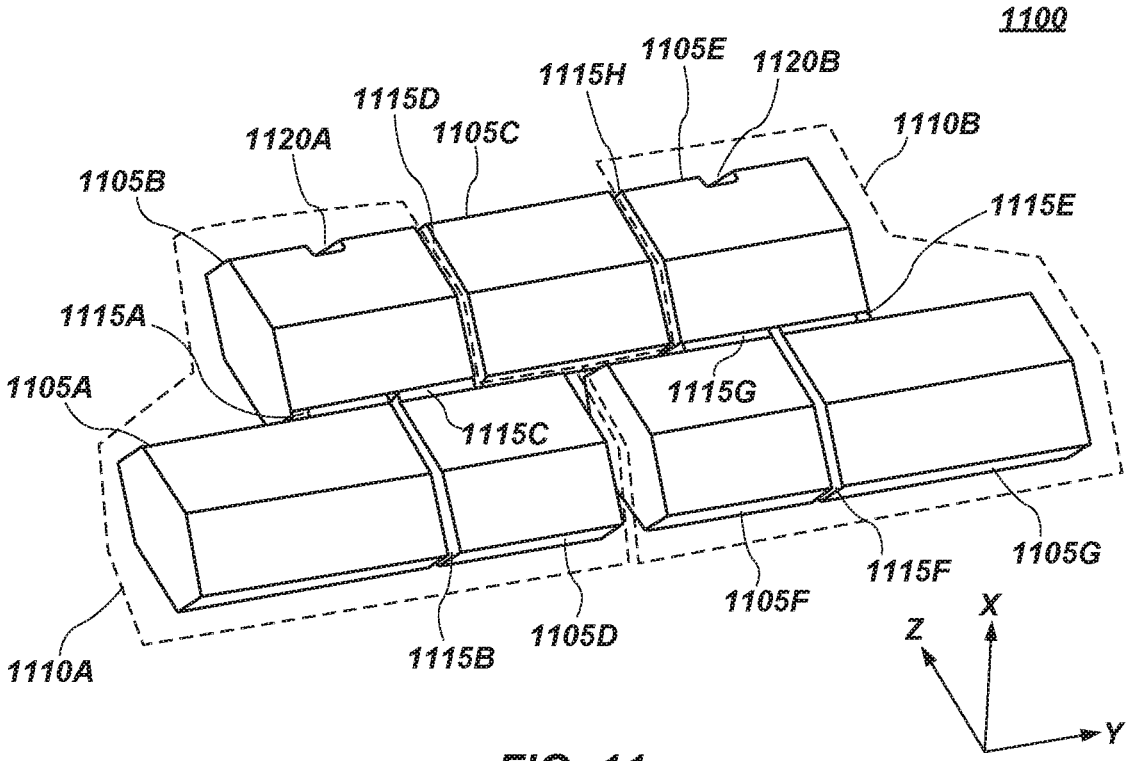
FIG. 11 illustrates another embodiment of an air volume of an irregular hexagonal waveguide including a first triplet combined with a second triplet.

FIG. 11 illustrates another embodiment of an air volume of an irregular hexagonal waveguide 1100 including a first triplet 1110A combined with a second triplet 1110B. Waveguide 1100 includes a waveguide 1105A and a waveguide 1105G which are the input and the output of the filter. Both waveguides 1105A and 1105G are implemented as waveguides and not resonant cavities. Further, waveguide 1100 may also be implemented as two of waveguide triplets 800, shown in FIG. 8. Waveguide 1100 further includes a first fundamental waveguide unit 1105B, a second fundamental waveguide unit 1105C, a third fundamental waveguide unit 1105D, a fourth fundamental waveguide unit 1105E, and a fifth fundamental waveguide unit 1105F.

As shown in FIG. 11, waveguide 1105A may act as an input for an electromagnetic signal while waveguide 1105G may act as an output for the filtered electromagnetic signal, as waveguide 1100 operates as a two triplet filter to achieve two transmission zeros above a passband. Alternatively, waveguide 1105G may act as an input for the input for the electromagnetic signal and waveguide 1105A may act as an output for the filtered electromagnetic signal. Further shown in FIG. 11, is a plurality of connections between the various waveguides 1105A-1105G. For example, as shown in FIG. 11, first triplet 1110A may be implemented as a waveguide 1105A and two resonant cavities which are implemented as third fundamental waveguide unit 1105D and first fundamental waveguide unit 1105B. Waveguide 1105A and fundamental waveguide units 1105D and 1105B may be joined together using connections described above. For example, waveguide 1105A may be connected to first fundamental waveguide unit 1105B at a sidewall junction 1115A, which may be similar in implementation and description to sidewall junction 515, shown in FIG. 5 and further connected to third fundamental waveguide unit 1105D by a sidewall junction 1115B, which may be similar in implementation and description to sidewall junction 415, shown and described with respect to FIG. 4, above. Third fundamental waveguide unit 1105D may further be connected to first fundamental waveguide unit 1105B by a sidewall junction 1115C. First triplet 1110A, therefore, includes three apertures at each of junctions 1115A, 1115B, and 1115C.

Second triplet 1110B may be implemented as a waveguide 1105G and two resonant cavities, which are implemented as fourth fundamental waveguide unit 1105E and fifth fundamental waveguide unit 1105F. Waveguide 1105G and fundamental waveguide units 1105E and 1105F may be joined together using connections described above. For example, waveguide 1105G may be connected to fourth fundamental waveguide unit 1105E at a sidewall junction 1115E which may be similar in implementation and description to sidewall junction 515, shown in FIG. 5, and further connected to fifth fundamental waveguide unit 1105F by a sidewall junction 1115F, which may be similar in implementation and description to sidewall junction 415, shown and described with respect to FIG. 4, above. Fourth fundamental waveguide unit 1105E may further be connected to fifth fundamental waveguide unit 1105F by a sidewall junction 1115G, which may be similar in implementation and description to junction 515, shown and described with respect to FIG. 5, above. The use of waveguide 1105G, fourth fundamental waveguide unit 1105E, and fifth fundamental waveguide unit 1105F may be referred to as a "triplet" due to the use of a waveguide with two resonant cavities. Second triplet 1110B, therefore, includes three apertures at each of junctions 1115E, 1115F, and 1115G.

First triplet 1110A and second triplet 1110B may further be interconnected. For example, waveguide 1105C may be connected to first triplet 1110A and second triplet 1110B in various ways. As shown in FIG. 11, second fundamental waveguide unit 1105C is connected to first fundamental waveguide unit 1105B with a sidewall junction 1115D, and to fourth fundamental waveguide unit 1105E with sidewall junction 1115H. Sidewall junctions 1115C and 1115D may be similar in implementation and description to junction 415, shown and described with respect to FIG. 4.

Any of junctions 1115A-1115G may be implemented as sidewall junctions or broadwall junctions, which have been described above, to facilitate any particular implementation of waveguide 1100, although, as shown in FIG. 11, each one of junctions 1115A-1115G are implemented as sidewall junctions of a first type or a second type. As shown in FIG. 11, waveguide 1100 provides two transmission zeros above a passband. In other words, waveguide 1100 is a filter that has improved filtering performance for frequencies in a signal that occur above a specified range of frequencies in a passband that are allowed to propagate through waveguide 1100. Implementing triplet 1110A and triplet 1110B provides for two transmission zeros below the passband to ensure that frequencies within a specified rejection band will have increased rejection due to complete cancellation of the electromagnetic energy at two prescribed frequencies which are set by the transmission zeros. It is also noted that first fundamental waveguide unit 1105B and fourth fundamental waveguide unit 1105E may include a resonance indentation 1120A and 1120B, respectively, which may be similar in implementation and description to resonance indent 220, shown and described above with respect to FIG. 2.

Figure 12:
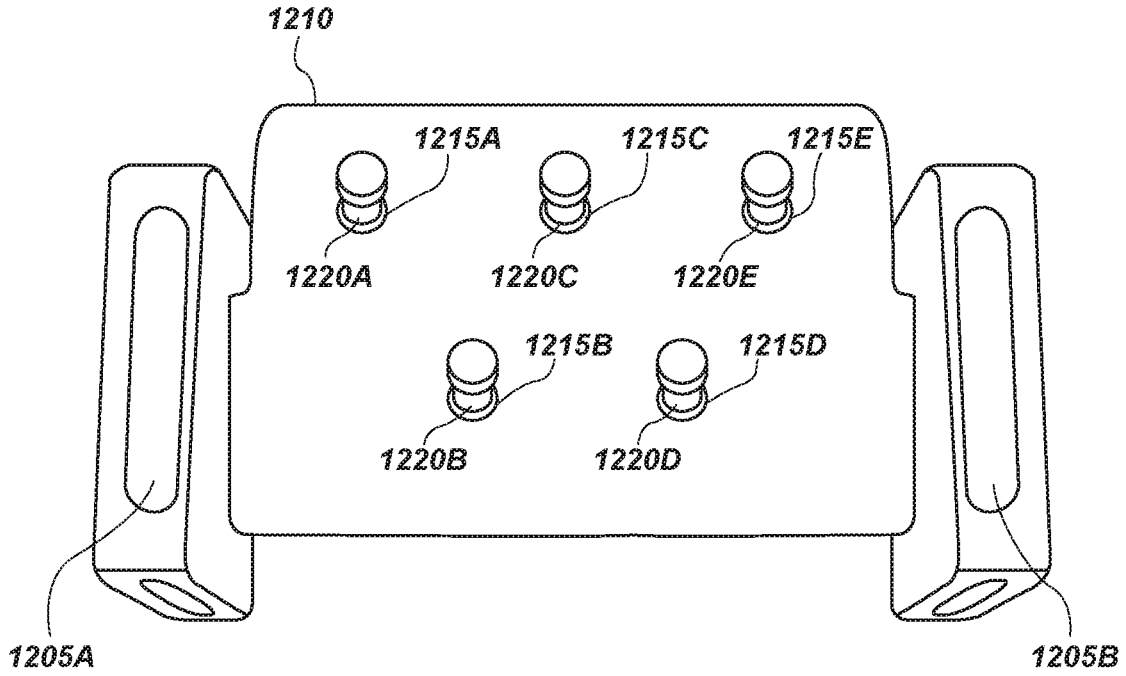
FIG. 12 illustrates another fabricated bandpass triplet filter.

FIG. 12 illustrates a fabricated bandpass triplet filter 1200, effectively implementing waveguide 1100 as a fabricated component. Filter 1200 includes a waveguide input 1205A and a waveguide output 1205B with a plurality of waveguides implemented in a filter section 1210. Filter section 1210 may include, for example, waveguides 1105B-1105F, shown in FIG. 11 and may provide each one of waveguides 1105B-1105F with a tuning orifice 1215A-1215E and a tuning screw 1220A-1220E to make minor tuning adjustments to waveguides 1105B-1105F in filter section 1210.

Filter 1200 provides two transmission zeros below a passband. In other words, filter 1200 filters out frequencies in a signal that occur below a specified range of frequencies in a passband that are allowed to propagate through filter 1200. Implementing triplet 1110A and triplet 1110B, shown in FIG. 11, respectively, within filter 1200 provides for two transmission zeros below the passband to ensure that frequencies within a specified rejection band will have increased rejection due to complete cancellation of the electromagnetic energy at two prescribed frequencies which are set by the transmission zeros.

Figure 13:
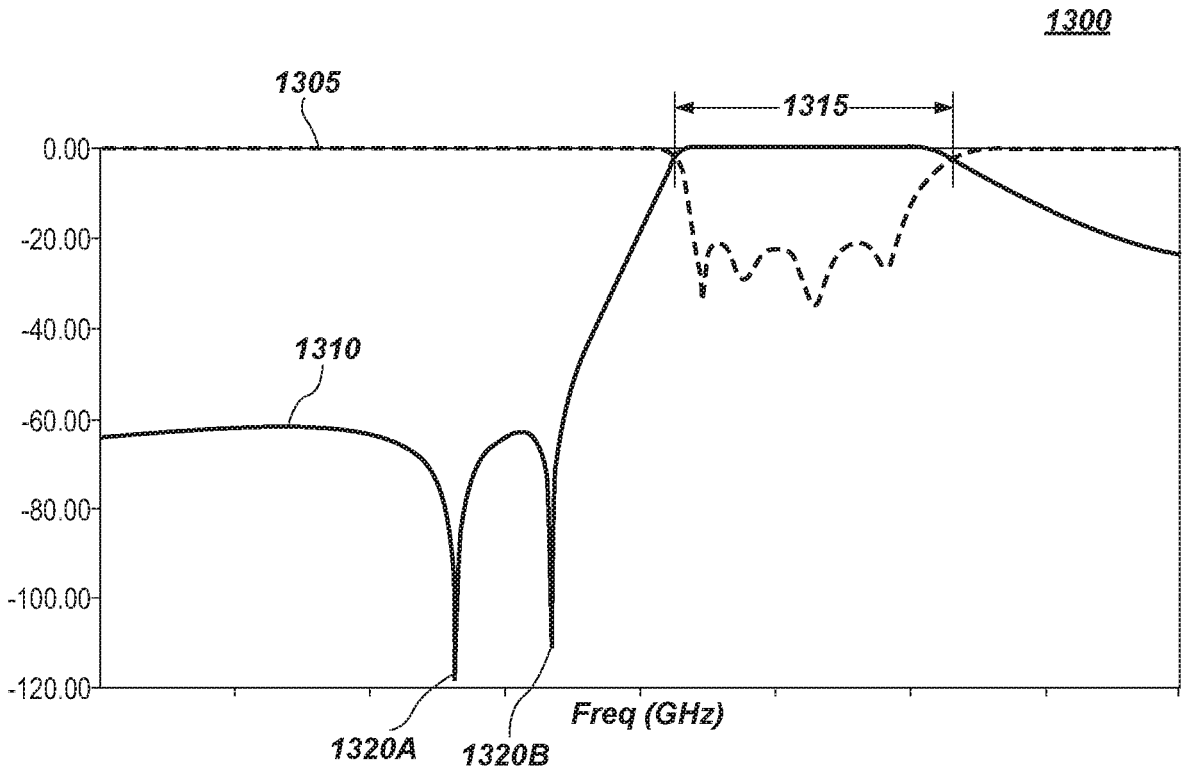
FIG. 13 illustrates a graphical performance of a bandpass filter.

FIG. 13 illustrates a graphical performance of a bandpass filter 1300. As shown in FIG. 13, filter 1300 shows an electromagnetic response of a bandpass filter with two zeros below passband 1315, which may be similar to waveguide 900 shown and described with respect to FIG. 9 and filter 1000, shown and described with respect to FIG. 10. Graph 1305 includes vertical axis shown in units of decibels (S-parameters) and a horizontal axis shown in units of GHz (frequency). Insertion loss (S21) 1310 of graph 1305 shows zeros at 1320A and 1320B with excellent cancellation shown by the sharp dip in the curve while also providing a low insertion loss (S21 near 0 dB) over a desired passband 1315. Additionally, return loss (S11) in red shows good performance (S11 below −20 dB) over the passband 1315. Accordingly, bandpass filter 1300 provides excellent electrical filtering capabilities below a particular passband and rejection band. It is also noted that the rejection band may be a point where insertion loss S21 1310 of graph 1305 is maintained below a defined value, which as shown in FIG. 13 is −60 dB, over a specified frequency band, below the passband 1315. By implementing zeros 1320A and 1320B in the rejection band, the roll off of S21 between zero 1320B and a bottom of passband 1315 would be much slower with a poorer rejection performance.

Figure 14:
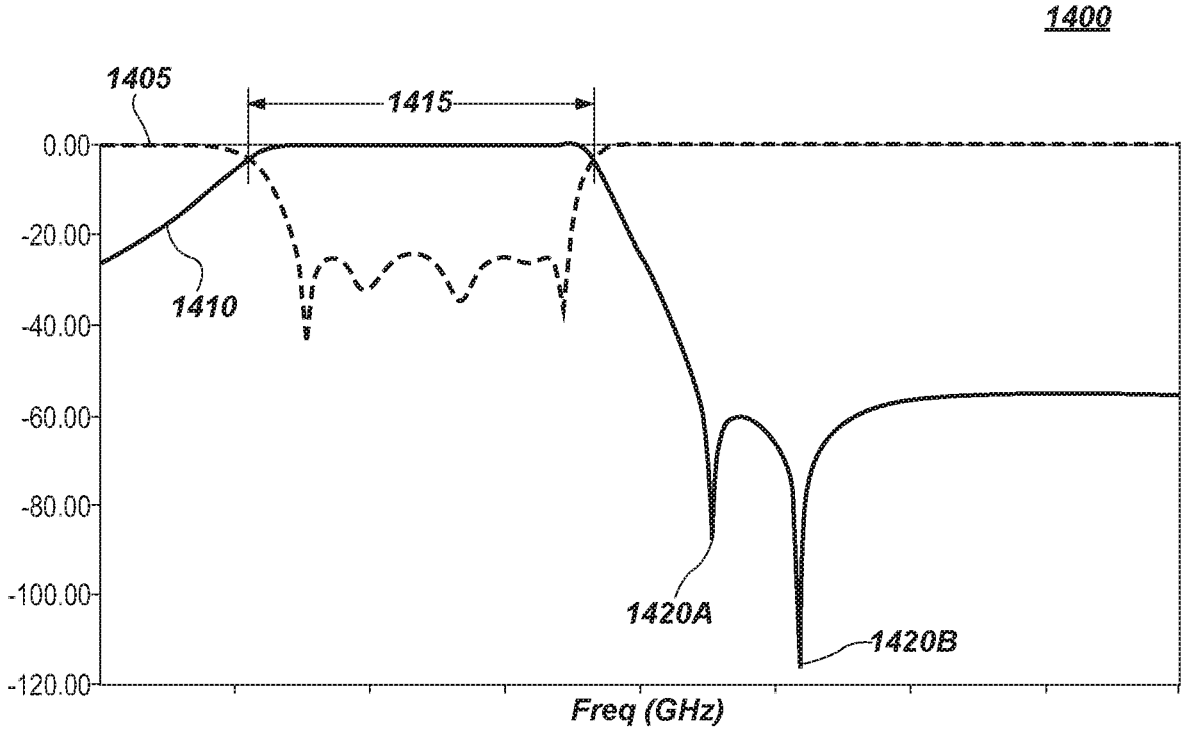
FIG. 14 illustrates a graphical performance of another bandpass filter.

FIG. 14 illustrates a graphical performance of a bandpass filter 1400. As shown in FIG. 14, filter 1400 shows an electromagnetic response of a bandpass filter with two zeros above a passband 1415, which may be similar to waveguide 1100 shown and described with respect to FIG. 11 and filter 1200, shown and described with respect to FIG. 12. Graph 1405 includes vertical axis shown in units of decibels (S-parameters) and a horizontal axis shown in units of GHz (frequency). Insertion loss (S21) 1410 of graph 1405 zeros at 1420A and 1420B with excellent cancellation shown by the sharp dip in the curve while also providing a low insertion loss (S21 near 0 dB) over a desired passband 1415. Additionally, return loss (S11) in red shows good performance (S11 below −20 dB) over the passband 1415. Accordingly, bandpass filter 1400 provides excellent electrical filtering capabilities above a particular passband and rejection band. It is also noted that the rejection band may be a point where insertion loss S21 1410 of graph 1405 is maintained below a defined value, which as shown in FIG. 14 is −60 dB, over a specified frequency band, above the passband 1415. By implementing zeros 1420A and 1420B in the rejection band, the roll off of S21 between zero 1420B and above a top of passband 1415 would be much slower with a poorer rejection performance.

EXAMPLES

The following examples pertain to features of further embodiments.

Example 1 is a waveguide filter that comprises a fundamental waveguide unit having an irregular hexagonal metal structure forming a connection along one or more walls of the irregular hexagonal metal structure to at least another fundamental waveguide unit having an irregular hexagonal metal structure.

Example 2 is the waveguide of example 1, wherein the connection is a broadwall connection.

Example 3 is the waveguide of example 1, wherein the connection is a sidewall connection.

Example 4 is the waveguide filter of example 3, wherein the sidewall connection includes a hexagonal aperture.

Example 5 is the waveguide filter of example 3, wherein the sidewall connection includes a rectangular aperture.

Example 6 is the waveguide filter of example 1, wherein the connection includes an aperture.

Example 7 is the waveguide filter of example 1, wherein the connection includes a rounded transition between the fundamental waveguide unit and the at least another fundamental waveguide unit.

Example 8 is the waveguide filter of example 1, wherein the fundamental waveguide unit includes a resonance indent.

Example 9 is the waveguide filter of example 1, wherein the another one of the one or more walls forms a connection between the fundamental waveguide unit and a waveguide.

Example 10 is the waveguide of example of claim 9, wherein the waveguide is longer than a fundamental waveguide unit.

Example 11 is the waveguide examples 9-10, wherein the fundamental waveguide unit, the at least another fundamental waveguide unit, and the waveguide is connected to a third fundamental waveguide unit.

Example 12 is the waveguide of examples 9-11, wherein the third fundamental waveguide unit is connected to a fourth fundamental waveguide unit.

Example 13 is the waveguide of examples 9-12, wherein the fourth fundamental unit is connected to a second waveguide.

Example 14 is the waveguide of examples 9-13, wherein the fourth fundamental unit is connected to a fifth fundamental waveguide unit.

Example 15 is the waveguide of examples 9-13 and 14, wherein the fifth fundamental waveguide unit is a second waveguide.

Example 16 is the waveguide of example 1, wherein one or more of the fundamental waveguide unit and the at least another fundamental waveguide unit includes a tuning orifice and a tuning screw.

Example 17 is the waveguide of example 1, wherein the another one of the one or more walls forms a connection between the fundamental waveguide unit and a waveguide wherein the waveguide is twice as long as a fundamental waveguide unit.

Example 18 is a fundamental waveguide unit that comprises a hollow irregular hexagonal metal structure which includes a resonant cavity that receives an electromagnetic signal and propagates the signal through the resonant cavity.

Example 19 is the fundamental waveguide unit of example 18, wherein the resonant cavity of the hollow irregular metal structure is connected to another resonant cavity of another fundamental waveguide unit.

Example 20 is the fundamental waveguide unit of examples 18-19, wherein the resonant cavity of the hexagonal metal structure is connected to a propagation channel of a waveguide.

The foregoing description has been presented for purposes of illustration. It is not exhaustive and does not limit the invention to the precise forms or embodiments disclosed.

Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A waveguide filter, comprising:

a fundamental waveguide unit having an irregular hexagonal metal structure forming a connection along one or more walls of the irregular hexagonal metal structure to at least another fundamental waveguide unit having an irregular hexagonal metal structure.

2. The waveguide filter of claim 1, wherein the connection is a broadwall connection.

3. The waveguide filter of claim 1, wherein the connection is a sidewall connection.

4. The waveguide filter of claim 3, wherein the sidewall connection includes a hexagonal aperture.

5. The waveguide filter of claim 3, wherein the sidewall connection includes a rectangular aperture.

6. The waveguide filter of claim 1, wherein the connection includes an aperture.

7. The waveguide filter of claim 1, wherein the connection includes a rounded transition between the fundamental waveguide unit and the at least another fundamental waveguide unit.

8. The waveguide filter of claim 1, wherein the fundamental waveguide unit includes a resonance indent.

9. The waveguide filter of claim 1, wherein the another one of the one or more walls forms a connection between the fundamental waveguide unit and a waveguide.

10. The waveguide filter of claim 9, wherein the waveguide is longer than a fundamental waveguide unit.

11. The waveguide filter of claim 9, wherein one or more of the fundamental waveguide unit, the at least another fundamental waveguide unit, and the waveguide is connected to a third fundamental waveguide unit.

12. The waveguide filter of claim 11, wherein the third fundamental waveguide unit is connected to a fourth fundamental waveguide unit.

13. The waveguide filter of claim 12, wherein the fourth fundamental waveguide unit is connected to a second waveguide.

14. The waveguide filter of claim 13, wherein the fourth fundamental waveguide unit is connected to a fifth fundamental waveguide unit.

15. The waveguide filter of claim 14, wherein the fifth fundamental waveguide unit is connected to a second waveguide.

16. The waveguide filter of claim 1, wherein one of more of the fundamental waveguide unit and the at least another fundamental waveguide unit includes a tuning orifice and a tuning screw.

17. The waveguide filter of claim 1, wherein the another one of the one or more walls forms a connection between the fundamental waveguide unit and a waveguide, wherein the waveguide is twice as long as a fundamental waveguide unit.

18. The waveguide filter of claim 1, wherein the irregular hexagonal metal structure of the fundamental waveguide unit and the irregular hexagonal metal structure of the at least another fundamental waveguide unit are fabricated by metal additive manufacturing as a single part.

19. The waveguide filter of claim 18, wherein one or more of the irregular hexagonal metal structures of the fundamental waveguide unit and the at least another fundamental waveguide unit comprises one or more downward facing surfaces;

wherein the one or more downward facing surfaces are fabricated by metal additive manufacturing to have overhang angles that are within a range of 45 degrees plus or minus 25 degrees.

20. A fundamental waveguide unit, comprising:

a hollow irregular hexagonal metal structure which includes a resonant cavity that receives an electromagnetic signal and propagates the signal through the resonant cavity.

21. The fundamental waveguide unit of claim 20, wherein the resonant cavity of the hollow irregular hexagonal metal structure is connected to another resonant cavity of another fundamental waveguide unit.

22. The fundamental waveguide unit of claim 21, wherein the resonant cavity of the hollow irregular hexagonal metal structure is connected to a propagation channel of a waveguide.

23. The fundamental waveguide unit of claim 20, wherein the hollow irregular hexagonal metal structure is fabricated by metal additive manufacturing as a single part.

* * * * *